US011174137B2

(12) United States Patent
Muller

(10) Patent No.: US 11,174,137 B2
(45) Date of Patent: Nov. 16, 2021

(54) TELESCOPING JIB COMPRISING A GUYING SYSTEM FOR A MOBILE CRANE AND GUYING METHOD THEREFOR

(71) Applicant: Tadano Demag GmbH, Zweibrücken (DE)

(72) Inventor: Laurent Muller, Butten (FR)

(73) Assignee: Tadano Demag GmbH, Zweibrücken (DE)

( * ) Notice: Subject to any disclaimer, the term of this patent is extended or adjusted under 35 U.S.C. 154(b) by 45 days.

(21) Appl. No.: 16/323,712

(22) PCT Filed: Aug. 10, 2017

(86) PCT No.: PCT/EP2017/070348
§ 371 (c)(1),
(2) Date: Feb. 6, 2019

(87) PCT Pub. No.: WO2018/029306
PCT Pub. Date: Feb. 15, 2018

(65) Prior Publication Data

US 2020/0189888 A1 Jun. 18, 2020

(30) Foreign Application Priority Data

Aug. 10, 2016 (DE) ..... 102016114837.7

(51) Int. Cl.
*B66C 23/82* (2006.01)
*B66C 23/70* (2006.01)
*B66C 23/66* (2006.01)

(52) U.S. Cl.
CPC ..... *B66C 23/826* (2013.01); *B66C 23/702* (2013.01); *B66C 23/66* (2013.01)

(58) Field of Classification Search
CPC ..... B66C 23/821–828; B66C 23/701–708; B66C 23/36; B66C 23/66; B66C 2700/0357
See application file for complete search history.

(56) References Cited

U.S. PATENT DOCUMENTS 1,325,053 A * 12/1919 Steidle ..... B66C 23/705 52/115
2,449,703 A * 9/1948 Johnson ..... B66D 3/046 254/406

(Continued)

FOREIGN PATENT DOCUMENTS

CN 201272663 Y 7/2009
CN 101857176 A 10/2010

(Continued)

OTHER PUBLICATIONS

Preliminary Report on Patentability of the International Searching Authority in English from corresponding Patent Cooperation Treaty (PCT) Application No. PCT/EP2017/070348, completed Oct. 29, 2018.

(Continued)

*Primary Examiner* — Sang K Kim
*Assistant Examiner* — Nathaniel L Adams
(74) *Attorney, Agent, or Firm* — Gardner, Linn, Burkhart & Ondersma LLP

(57) ABSTRACT

A telescoping jib of a mobile crane with telescoping sections that telescope inwards and outwards from a jib base casing, and a guying system for the telescoping jib having at least one cable extending between a guying frame and a fixed point by a guying support and is anchored by guying supports, where each guying support comprises a holding mechanism for the cable. A method for guying a telescoping jib of a mobile crane in which at least one cable is anchored between a guying frame on the telescoping jib consisting of a jib base casing and a plurality of telescoping segments and a fixed point on the telescoping jib, and the at least one cable is guided by means of at least one guying support supported on the jib base casing head or a telescoping segment head of the telescoping jib.

14 Claims, 7 Drawing Sheets

(56) References Cited

U.S. PATENT DOCUMENTS

| | | | | |
|---|---|---|---|---|
| 3,830,376 | A | 8/1974 | Fritsch | |
| 4,004,695 | A | 1/1977 | Hockensmith et al. | |
| 4,360,111 | A * | 11/1982 | Weiskopf | B66C 23/76 212/196 |
| 4,982,853 | A | 1/1991 | Kishi | |
| 9,637,358 | B2 | 5/2017 | Knecht et al. | |
| 2002/0070187 | A1 * | 6/2002 | Willim | B66C 23/701 212/299 |
| 2004/0129663 | A1 | 7/2004 | Willim | |
| 2008/0169258 | A1 | 7/2008 | Weisbauer | |
| 2018/0044149 | A1 | 2/2018 | Weckbecker et al. | |
| 2018/0327234 | A1 | 11/2018 | Martin et al. | |
| 2018/0339889 | A1 | 11/2018 | Kuhn et al. | |
| 2018/0346291 | A1 | 12/2018 | Martin et al. | |
| 2018/0346292 | A1 | 12/2018 | Kuhn et al. | |
| 2019/0359457 | A1 | 11/2019 | Muller | |

FOREIGN PATENT DOCUMENTS

| | | | |
|---|---|---|---|
| CN | 202558505 | U | 11/2012 |
| CN | 104555760 | | 4/2015 |
| DE | 3447095 | C2 | 4/1995 |
| DE | 10062517 | C2 | 12/2002 |
| DE | 20203443 | | 5/2003 |
| DE | 20208740 | U1 | 10/2003 |
| DE | 20219126 | U1 | 4/2004 |
| DE | 10315989 | A1 | 11/2004 |
| DE | 102015009156 | A1 | 2/2016 |
| EP | 1213254 | | 6/2002 |
| EP | 1266861 | A1 | 12/2002 |
| EP | 1354842 | B1 | 12/2004 |
| EP | 2504267 | B1 | 7/2013 |

OTHER PUBLICATIONS

International Search Report of the International Searching Authority from corresponding Patent Cooperation Treaty (PCT) Application No. PCT/EP2017/070348, indicated completed on Nov. 24, 2017.

Written Opinion of the International Searching Authority from corresponding Patent Cooperation Treaty (PCT) Application No. PCT/EP2017/070348, indicated completed on Nov. 24, 2017.

International Preliminary Examination Report from corresponding Patent Cooperation Treaty (PCT) Application No. PCT/EP2017/70348, dated Oct. 29, 2018.

* cited by examiner

TELESCOPING JIB COMPRISING A GUYING SYSTEM FOR A MOBILE CRANE AND GUYING METHOD THEREFOR

CROSS REFERENCE TO RELATED APPLICATION

The present application claims the priority benefits of International Patent Application No. PCT/EP2017/070348, filed Aug. 10, 2017, and claims benefit of German patent application DE10 2016 114 837.7, filed Aug. 10, 2016.

BACKGROUND OF THE INVENTION

The invention relates to a telescoping jib of a mobile crane with a plurality of telescoping sections which can telescope inwards and outwards from a jib basic box and with a guying system for guying the telescoping jib, which guying system comprises at least one cable which extends between at least one tensioning frame and at least one fixed point by means of at least one guying support, and the guying support comprises a holding mechanism for the cable.

Furthermore, the invention relates to a method for guying a telescoping jib of a mobile crane, in which at least one cable is guyed between a tensioning frame on the telescoping jib, consisting of a jib basic box and a plurality of telescoping sections, and a fixed point on the telescoping jib, and the at least one cable is guided by means of at least one guying support supported on the jib basic box head or a telescoping section head of the telescoping jib.

A telescoping crane jib is known from the German laid-open document DE 10 2015 009 156 A1. The crane jib consists of a base section and one or more telescoping sections. In order to increase the load-bearing capacity of the crane jib a guying arrangement is provided consisting of a single pair of guying supports and traction means. The pair of guying supports is disposed in a v shape on a head end of a first telescoping section and extends perpendicularly to the crane jib. The traction means are on the one hand fastened at a foot end of the base section to cable winches and on the other hand to a head end of a second telescoping section. The two traction means also extend along the crane jib and are each guided via one of the two guying supports in the region of their free ends. For this purpose deflecting rollers are disposed on each of the guying supports and the respective cable is looped around them at least once. Each deflecting roller can be fixed via a holding function. The traction means are wound or unwound by the cable winches as the crane jib is being retracted and extended and are then tensioned after extension has taken place. After tensioning, the deflection rollers are also fixed. The tensioning of the traction means causes the crane jib to be relieved of loading and sagging of the crane jib is reduced or avoided.

The German patent document DE 34 47 095 C2 discloses a further telescoping jib on a superstructure of a crane. The telescoping jib is guyed by an arrangement of tensioning cables and deflecting rollers. The tensioning cables are respectively fastened to each head end of the respective telescoping sections and come together at a tensioning cylinder attached to the superstructure.

A mobile crane with a telescoping crane jib with three telescoping partial jibs is known from the European patent document EP 2 504 267 B1. The partial jibs extend in parallel and spaced apart from each other. The spacing is achieved via triangular connection plates, the partial jibs respectively extending in the corners thereof. The connection plates are each disposed in the region of head ends of the partial jibs and at a foot end of the base partial jib.

The U.S. Pat. No. 4,982,853 A discloses a mobile crane with a telescoping jib basic box and a plurality of telescoping sections which support a guying system. The guying system consists of three cables and has two guying supports attached to the end of the telescoping section heads so that the telescoping jib is guyed. One of the cables runs over deflecting rollers through one of the guying supports and is fastened to the head of the telescoping section. A holding mechanism for one of the cables is not shown.

German laid-open document DE 103 15 989 A1 likewise describes a mobile crane with a telescoping jib consisting of a plurality of telescoping sections. In order to guy or pre-tension the telescoping jib a tensioning cable is guided from a cable winch via a roller on a first guying support and through a second guying support, deflected at a roller at the tip of the mast into the telescoping jib and secured at a fastening point. The first guying support is fastened to an inner end of the jib basic box and comprises no through-hole for the cable but rather a roller disposed above. Moreover, not every telescoping section has a guying support and holding mechanisms for the cable are not provided.

A telescoping jib with a telescoping jib basic box and a plurality of telescoping sections is known from the Chinese utility model CN 202 558 505 U. A first guying system consisting of a centrally attached main guying support and two laterally attached guying supports is fastened to the telescoping jib basic box. A second guying system is located on one of the telescoping sections and likewise consists of three guying supports, one disposed centrally and two laterally. Cables extend through the guying supports and are fastened to the head of the mast. The first guying system is neither attached to the head of the jib basic box nor is a guying support or holding mechanisms for the cables located on each telescoping section.

The German utility model DE 202 19 126 U1 discloses a telescoping jib of a crane with a telescoping jib basic box and a plurality of telescoping sections. A guying arrangement is provided with two guying cables in order to guy the telescoping jib, said cables being guided over deflecting rollers disposed on guying brackets. However, a guying support is not provided on each telescoping section and in particular on the head of the jib basic box. Moreover, no holding mechanisms for the guying cables are disclosed.

SUMMARY OF THE INVENTION

The object of the invention is to create a telescoping jib for a mobile crane with a guying system and a guying method therefor having a constructionally simplified and lighter construction and an increase in the bearing load while the telescoping jib dimensions remain unchanged.

In accordance with an embodiment of the invention, in a telescoping jib of a mobile crane with a plurality of telescoping sections which can telescope inwards and outwards from a jib basic box and with a guying system for guying the telescoping jib, which guying system comprises at least one cable which extends between at least one tensioning frame and at least one fixed point by means of at least one guying support, and the guying support has a holding mechanism for the cable an increase in the bearing load and a constructionally simplified and lighter construction is achieved in that in each case at least one guying support is disposed at the outer end of a jib basic box head and in each case at least one guying support is disposed at the outer end of a telescoping section head and the guying support on the telescoping section head of the innermost telescoping section supports the fixed point and the guying supports on the remaining telescoping sections and on the jib basic box support a holding mechanism for the cable. The guying supports are fixedly disposed on the jib basic box and on at least one of the telescoping sections. This renders bracing of the guying system unnecessary. The higher number of guying supports means that as a whole a lighter and more compact construction, in particular construction height, can be achieved during transportation.

The holding mechanism holds the cable by means of a frictional and/or interlocking connection.

A space-saving implementation of the guying system is achieved in that in accordance with the invention each guying support is disposed in each case at the outer end of a jib basic box head or of a telescoping section head. In this way the telescoping jib is not prevented from telescoping inwards completely. This therefore allows a reduction in the telescoping jib to a compact size in the transportation condition.

In a further embodiment of the invention, provision is made that a guying support is disposed in each case on the jib basic box and on each telescoping section. The telescoping jib can thus be guyed at a plurality of points, which in turn increases the stability of the guying arrangement and improves the bearing load of the telescoping jib. A lighter and smaller construction can thus also be implemented for the same bearing load.

The guying system is constructionally simplified in that each guying support comprises a through-hole for the cable which is to be passed through.

For a particularly simple implementation of the guying system, provision is made that the holding mechanism comprises a movable holding element with which the cable can be secured in an operating condition in the through-hole against a counter holding element.

In a further embodiment of the invention, provision is made that the at least one tensioning frame of the guying system is disposed on the jib basic box.

A constructional simplification is achieved in that the cable is secured to the tensioning frame and to the last telescoping section head of the last telescoping jib. This results in a fixedly installed, space-saving guying system which requires no further bracing.

A further improvement in the stability and bearing load of the telescoping jib is achieved in that a first tensioning frame and a second tensioning frame are disposed on the jib basic box and cooperate with a first cable and a second cable which extend in parallel with each other and in the longitudinal direction of the telescoping jib.

A particularly secure and stable guying arrangement is achieved in that each guying support comprises two limbs which, as seen in the longitudinal direction of the telescoping jib, from the middle of the telescoping jib, are disposed on the right and left on the telescoping jib and form an angle of 45° to 135°, preferably 90°.

In order to design the telescoping jib in a space-saving but stable manner provision is made that successive telescoping sections and the jib basic box can be secured to one another.

A simplified and space-saving method for guying a telescoping jib, in which at least one cable is guyed between a tensioning frame on the telescoping jib, consisting of a jib basic box and a plurality of telescoping sections, and a fixed point on the telescoping jib, and the at least one cable is guided by means of at least one guying support supported on the jib basic box head or a telescoping section head of the telescoping jib is achieved in that the telescoping sections are extended out of the jib basic box, the at least one cable is tensioned between the tensioning frame and the fixed point and the at least one cable is secured on the guying support via a holding mechanism.

An improvement in the bearing load is achieved by a method in that, starting from a transportation condition of a retracted telescoping jib, beginning with the last telescoping section in the longitudinal direction of the telescoping jib and continuing with the adjoining telescoping section in each case, after each extension of a telescoping section the at least one cable of the guying system is tensioned by the at least one tensioning frame and secured by the holding mechanism.

An exemplified embodiment of the invention is explained in greater detail hereinafter.

DESCRIPTION OF THE PREFERRED EMBODIMENTS

Figure 1:
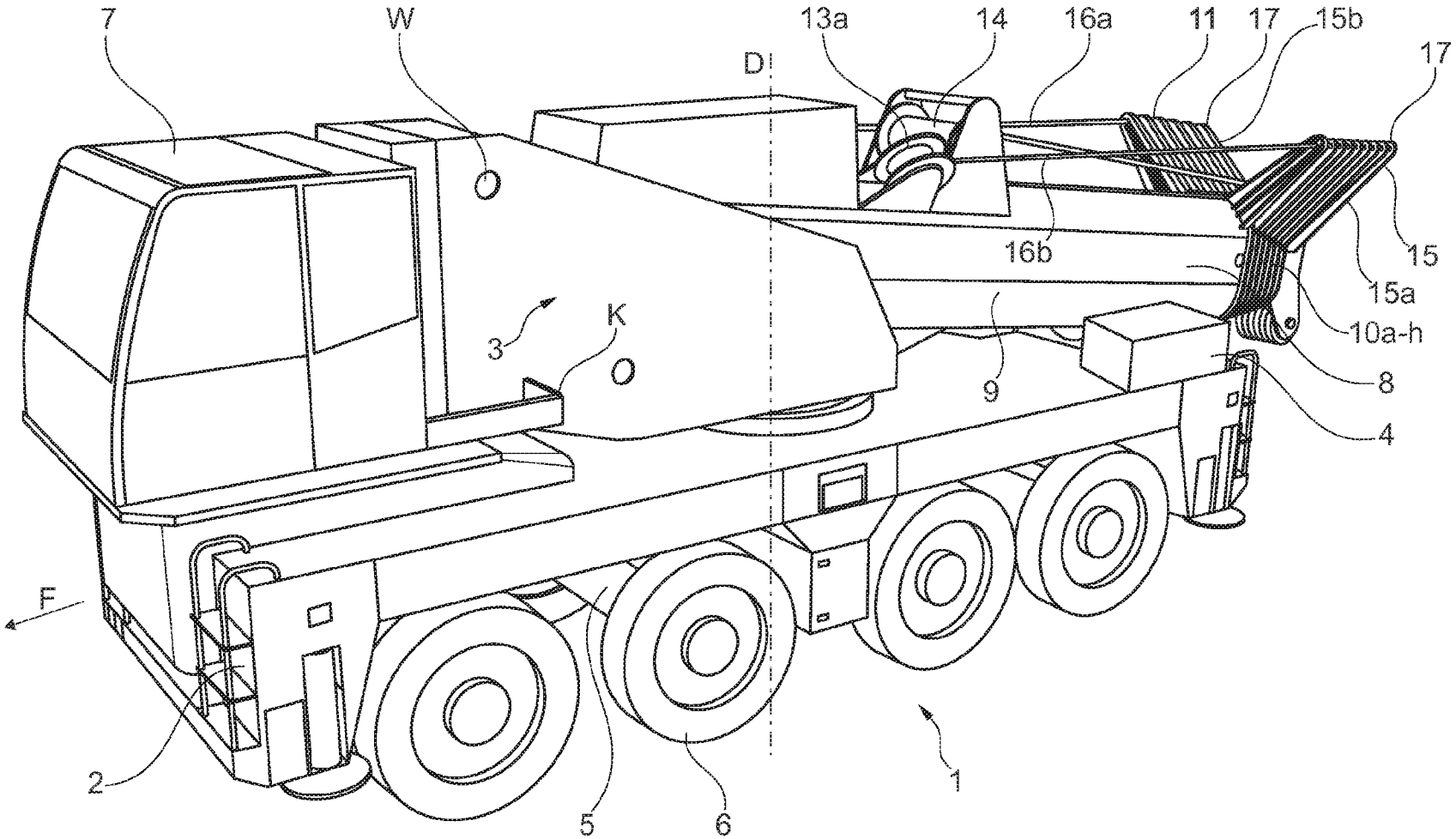
FIG. 1 shows a perspective view of a mobile crane with a telescoping jib.

FIG. 1 shows a perspective view of a mobile crane designated by 1. The mobile crane 1 comprises essentially a lower carriage 2 and a superstructure 3. The lower carriage 2 supports counterweights 4 and comprises four vehicle axles 5 each with two wheels 6 suitable for road travel. Furthermore, the lower carriage 2 supports the superstructure 3, which can pivot with respect to the lower carriage 2 about a substantially vertically orientated axis of rotation D. The superstructure 3 and lower carriage 2 can naturally also be rigidly mounted one on another. A combined driver's and crane operator's cabin 7 which can pivot about a vertical axis K from front to back and vice versa and a telescoping jib 8 are attached to the superstructure 3, which telescoping jib is fully retracted and laid down on the lower carriage 2 opposite to a forwards travel direction F of the mobile crane 1 for road travel. It is naturally also possible to form the driver's and crane operator's cabin 7 separately from each other.

Figure 2:
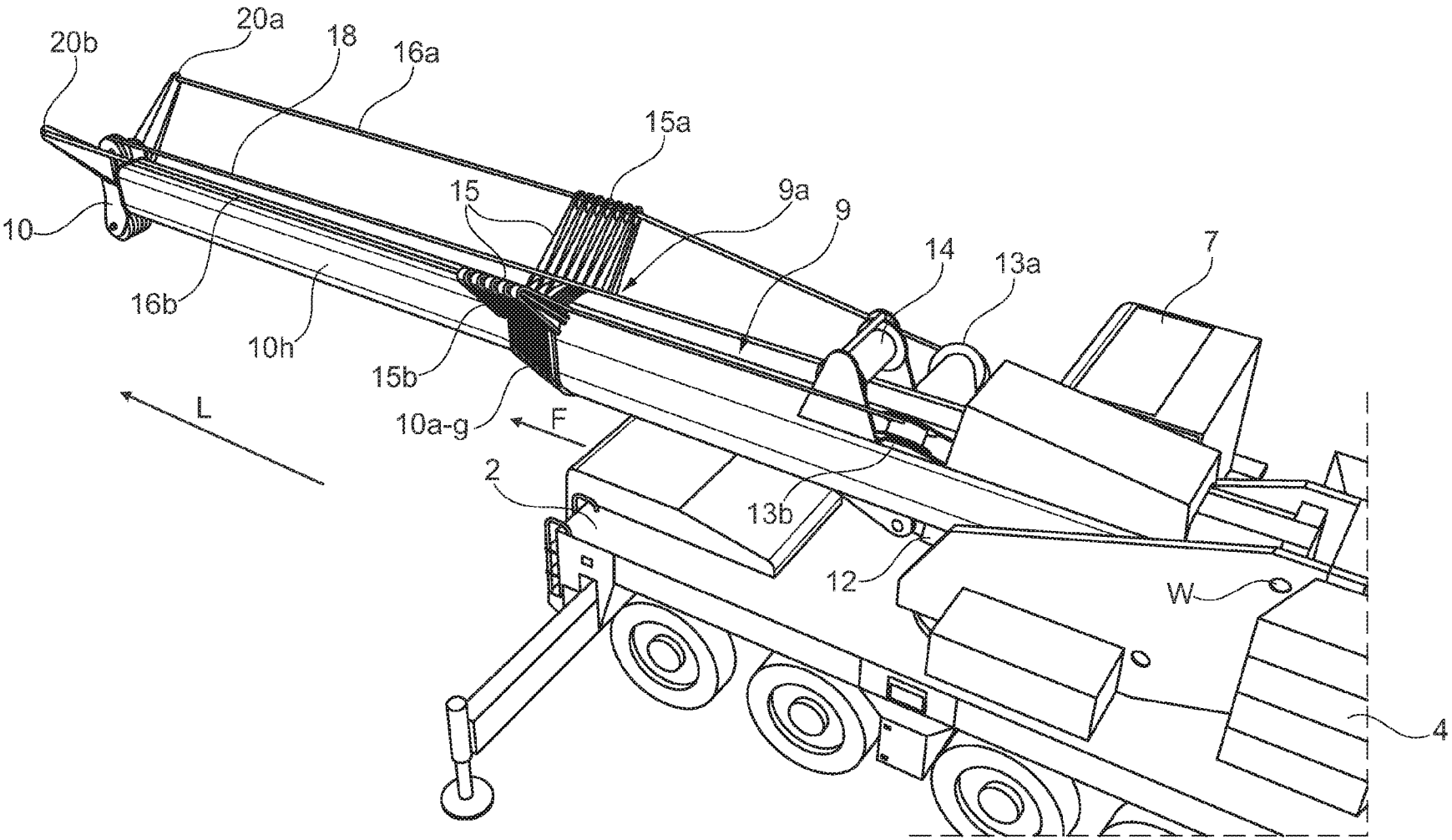
FIG. 2 shows a perspective partial view of a mobile crane according to FIG. 1 with a partially extended telescoping jib.

The telescoping jib 8 has a guying system 11 in order to achieve an increase in the bearing load while keeping the dimensions of the telescoping jib 8 unchanged, and consists of a jib basic box 9 and a plurality of telescoping sections 10*a-h*. The jib basic box 9 is connected at its foot to the superstructure 3 via a horizontal luffing axis W and can be erected via a luffing cylinder 12 (see FIG. 2 in relation thereto). Tensioning frames 13*a*, 13*b* of the guying system 11 and a lifting mechanism 14 are also located on the jib basic box 9 and therefore not on the superstructure 3. The tensioning frames 13*a*, 13*b* are designed as driven, breakable and fixable winches with an electrical or hydraulic drive and a drum for a cable 16*a*, 16*b* which can be wound and unwound. However, attachment of the tensioning frames 13*a*, 13*b* at that location and not on the jib basic box 9 is also possible. The jib basic box 9 receives the telescoping sections 10*a-h* within it in a conventional manner, these each being disposed one inside another and being extendible and retractable. In the extended condition, the telescoping sections 10*a-h* are connected to one another via bolts. The foot of the inner, and therefore smaller, telescoping section 10*a-h* in each case is bolted, by means of a fitting bolting position hole, to the next outer and larger telescoping section 10*a-h* in each case or to the jib basic box 9. In FIG. 2, the foot of the telescoping section 10*h* is therefore connected to the bolting position hole of the telescoping section 10*g* located on the head 10. The guying system 11 comprises v-shaped guying supports 15 disposed on the outer end—as seen in the longitudinal direction L of the telescoping jib 8—of a head 9*a* of the jib basic box 9 and of a head 10 of each telescoping section 10*a-h*. Each v-shaped guying support 15 comprises a first limb 15*a* and a second limb 15*b*. The first limbs 15*a* and second limbs 15*b* of the guying supports 15 are each disposed—as seen with the telescoping jib 8 orientated horizontally—on the outside and at the top in the region of corners of the telescoping sections 10*a-h*, which have a substantially four-sided cross-section, or of the jib basic box 9, which has a substantially four-sided cross-section, and extend upwards and outwards in an inclined manner. An opening angle a of the two limbs 15*a* and 15*b* is about 45-135°, preferably 90°. In this case, both limbs 15*a* and 15*b* lie in a common notional plane which is orientated at a right angle to a longitudinal direction L of the telescoping jib 8. The limbs 15*a* and 15*b* themselves have a stretched triangle-like shape, wherein a base side of the triangle lies on the telescoping section 10*a-h* or on the jib basic box 9 and a point of the triangle is provided with a respective through-hole 22*a* and 22*b* for the first cable 16*a* or the second cable 16*b*. The cables 16*a* and 16*b* are fastened respectively to the left or right limb 15*a* and 15*b* of the last telescoping section 10*h*—i.e. the one furthest from the jib basic box 9—at a fixed point 20*a* and 20*b* on the respective guying support 15. One of the two cables 16*a* and 16*b* is guided respectively over all the right and all the left limbs 15*a* and 15*b* of the guying supports 15 and fastened and tensioned at the foot of the jib basic box 9 at one of the right and left tensioning frames 13*a* and 13*b* located at the opposing end (see FIG. 2 in relation thereto). A respective holding mechanism 17, which secures the cables 16*a* and 16*b* after tensioning, is located at the end of the limbs 15*a* and 15*b* of the jib basic box 9 and of the telescoping sections 10*a-g* except on the last telescoping section 10*h*. The tensioning of the cables 16*a* and 16*b* is preferably effected by a combination of tensioning via the tensioning frames 13*a* and 13*b*, firm holding in the holding mechanisms 17 and further tensioning by outwards telescoping of the respective telescoping section 10*a-h*. It is fundamentally also feasible to tension either only by means of the tensioning frames 13*a* and 13*b* or by the outwards telescoping movement. Finally, the cables 16*a* and 16*b* are therefore secured and tensioned at a plurality of points between the fixed points 20*a* and 20*b* on the last telescoping section 10*h* and the tensioning frames 13*a* and 13*b* in the region of the guying supports 15. The guying system 11 is therefore fixedly installed on the mobile crane 1 and requires no subsequent bracing.

FIG. 2 shows a perspective partial view of a mobile crane 1 according to FIG. 1 with a partially extended telescoping jib 8. The last telescoping section 10*h* is extended; the remaining telescoping sections 10*a-g* are still retracted. For crane operation, the superstructure 3 is rotated by 180° from the position for road travel (see FIG. 1 in relation thereto) so that the telescoping jib 8 points in the forwards travel direction F. The driver's and crane operator's cabin 7 has now been displaced into a position suitable for crane operation, laterally of the superstructure 3. On the upper side and in the foot region of the jib basic box 9, the two tensioning frames 13*a* and 13*b* are disposed in the region of the corners of the telescoping jib 8 in such a way that the drums thereof point upwards and outwards and a rolling axis of the tensioning frames 13*a* and 13*b* is at a right angle to the longitudinal direction L of the telescoping jib 8. The lifting mechanism 14 is disposed thereafter as seen in the direction of the head 9*a* of the jib basic box 9. The drum of the lifting mechanism 14 points upwards and a rolling axis of the lifting mechanism 14 is likewise disposed at a right angle to the longitudinal direction L of the telescoping jib 8. A lifting cable 18 is wound and unwound by the lifting mechanism 14 and extends from the lifting mechanism 14 along and above the telescoping jib 8 to the end of the last telescoping section 10*h*. At the end of the last telescoping section 10*h* is a deflecting roller 19, over which the lifting cable 18 is guided.

The operation of the guying system 11 will be explained hereinunder with the aid of FIG. 2. In a first step, the innermost telescoping section 10*h* of the telescoping jib 8 is extended and at the same time the cables 16*a*, 16*b* secured in the fixed points 20*a*, 20*b* of the limbs 15*a* and 15*b* of the guying support 15 of the innermost telescoping section 10*h* are carried along in the longitudinal direction L of the telescoping jib 8 and therefore unwound from the tensioning frames 13*a*, 13*b*. In this case, the cables 16*a*, 16*b* are guided through the through-holes 22*a*, 22*b* of the guying supports 15 of the other telescoping sections 10*a-g* which have not yet been extended. In the retracted condition of the telescoping sections 10*a-h*, the guying supports 15 lie closely against one another with little spacing. Shortly before reaching a desired bolting position of the innermost telescoping section 10*h*, the cables 16*a* and 16*b*, which are already subject to basic tensioning via the tensioning frames 13*a*, 13*b*, are secured on the limbs 15*a* and 15*b* by the two holding mechanisms 17 of the adjacent telescoping section 10*g*. Owing to further extension of the telescoping section 10*h* into its bolting position for the full extension path, the upper part of the cables 16*a*, 16*b* is then further tensioned between the fixed points 20*a*, 20*b* of the limbs 15*a* and 15*b* of the guying support 15 of the innermost telescoping section 10 and the two holding mechanisms 17 of the adjacent telescoping section 10*g*. It is fundamentally possible to provide different bolting positions for each telescoping section 10*a-h*, these bolting positions then fixing a telescoping section 10*a-h* in a full or half or otherwise preselected extension path of the telescoping section 10*a-h*. In a similar manner, the cables 16*a*, 16*b* are then successively tensioned in portions between the respective guying supports 15 of the telescoping sections 10*a-g* and of the jib basic box 9 in parallel with the extension and bolting of the further telescoping sections 10*a-g*. It is important in this that the guying of the cables 16*a*, 16*b* takes place not only between the fastening points 20*a* and 20*b* and the tensioning frames 13*a* and 13*b*, but also between the guying supports 15 adjacent thereto and in each case between the adjacent guying supports 15.

Figure 3:
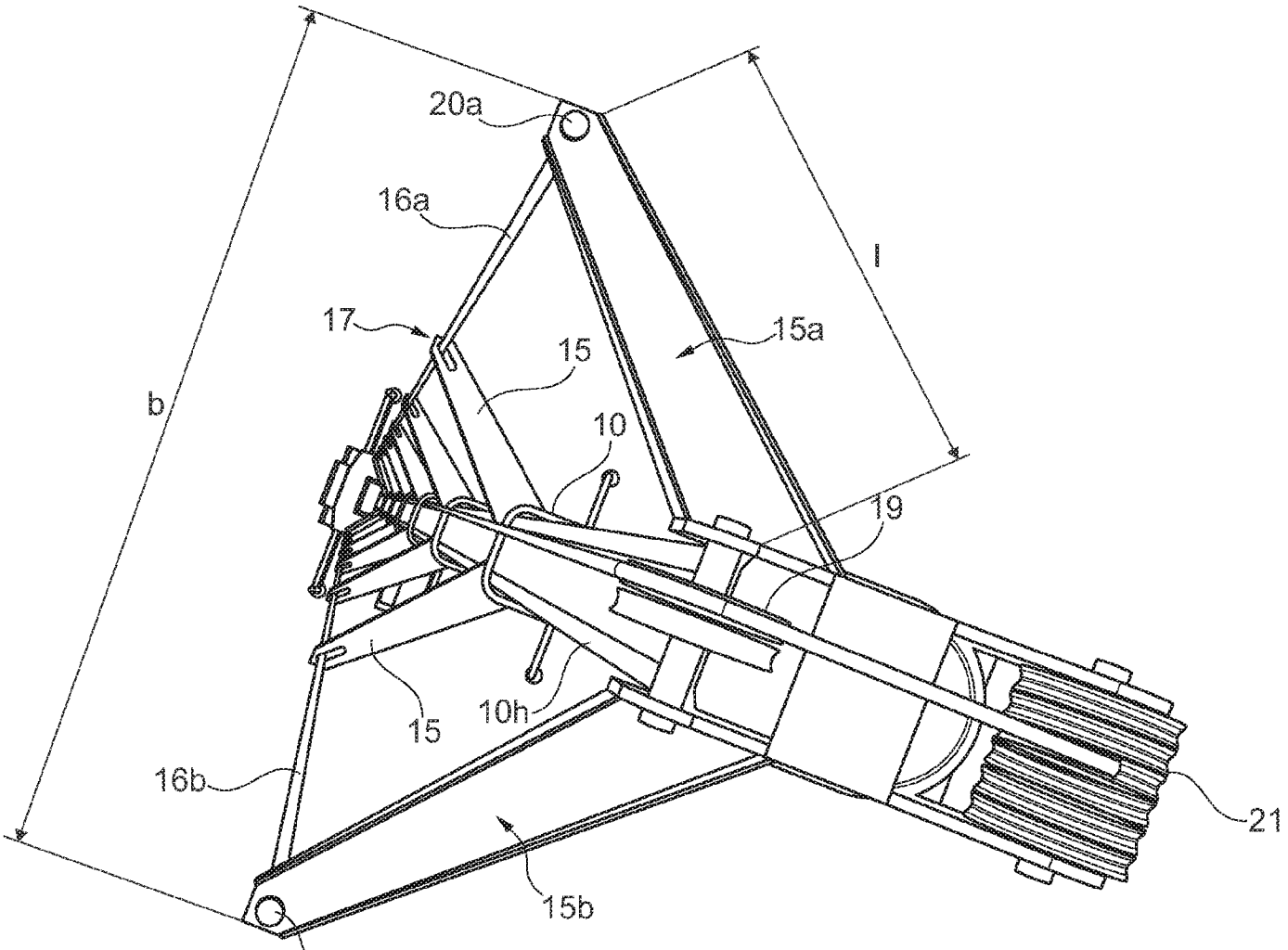
FIG. 3 shows a perspective plan view of a completely extended telescoping jib.

FIG. 3 shows a perspective plan view of a completely extended telescoping jib 8. The guying supports 15 are disposed on each telescoping section head 10 and on the jib basic box head 9*a* and therefore spaced apart from one another. The limbs 15*a* and 15*b* of the guying support 15 are disposed laterally on the right and left on the telescoping jib 8. The cables 16*a* and 16*b* are fastened to the limbs 15*a* and 15*b* of the guying support 15 of the last telescoping section 10*h* at a first and second fixed point 20*a* and 20*b*. The lifting cable 18 extending between the limbs 15*a* and 15*b* of the last telescoping section 10*h* extends below the limbs 15*a* and 15*b* over a deflecting roller 19 and then over a guide roller 21.

Figure 4:
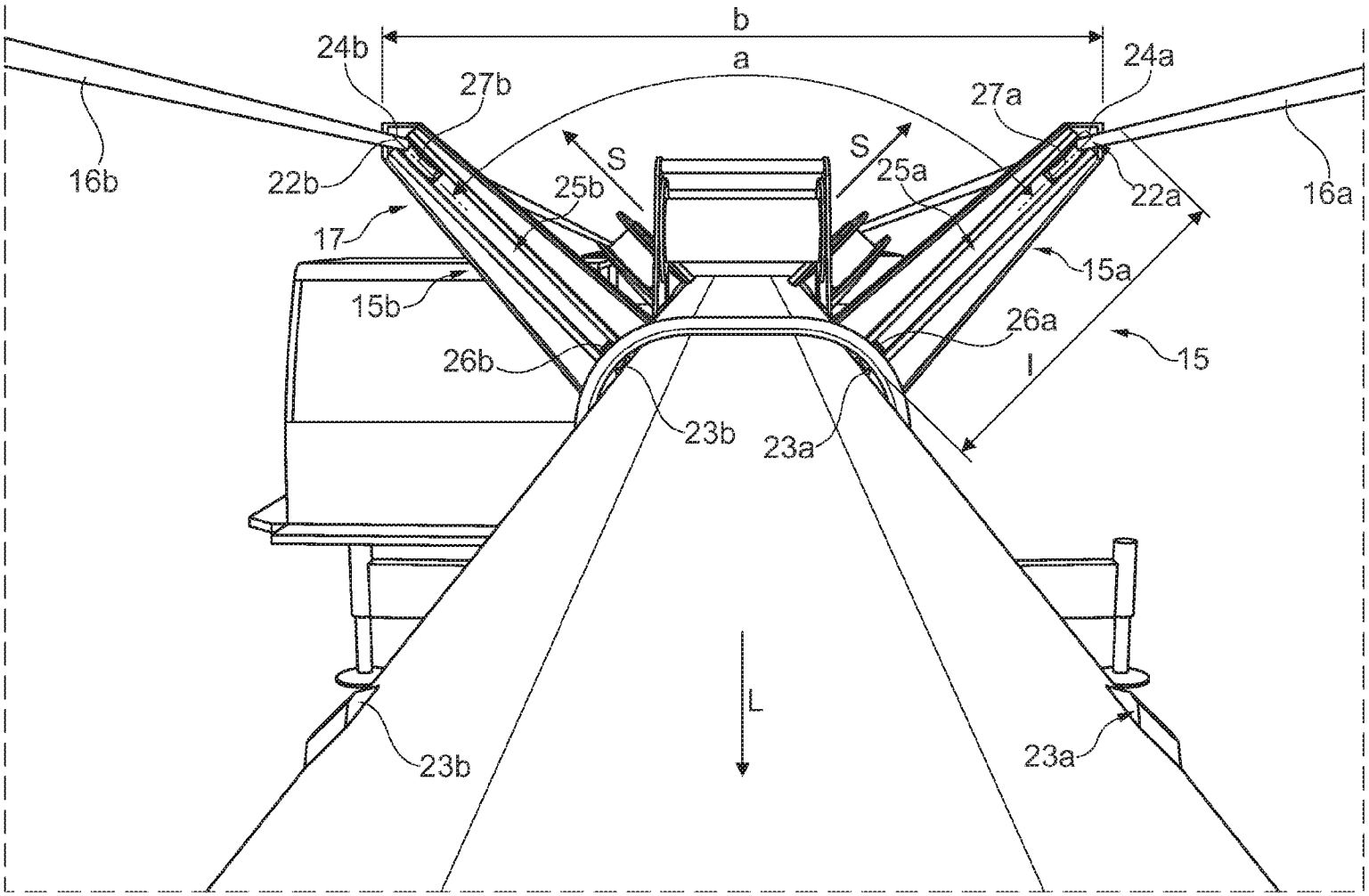
FIG. 4 shows a view of a detail of a guying support on the telescoping jib.

FIG. 4 shows a view of a detail of the limbs 15*a* and 15*b* of a guying support 15 of the telescoping jib 8. The holding mechanism 17 consists in each case substantially of a first counter holding element 24*a* or second counter holding element 24*b*, which each cooperate with a first holding element 27*a*, in particular in the form of a cable roller, or with a second holding element 27*b*, in particular in the form of a cable roller, in order to secure or clamp-in the respective cable 16*a*, 16*b* therebetween. The counter holding element 24*a*, 24*b* is in each case formed as a stationary contact surface of the respective limb 15*a* and 15*b* and is located in each case at an end of the limbs 15*a* and 15*b* remote from the telescoping jib 8 and adjoining the through-holes 22*a* and 22*b*. The contact surface is adapted to the contour of the cable 16*a*, 16*b* and can have increased frictional resistance. In order to be able to move the holding elements 27*a*, 27*b* in a pushing direction S, which is parallel to the longitudinal extension of the limbs 15*a* and 15*b*, in the direction of the counter holding elements 24*a*, 24*b*, each of the limbs 15*a* and 15*b* receives a rod-like pushing element 25*a*, 25*b*. The pushing element 25*a*, 25*b* is therefore integrated into the respective limb 15*a* and 15*b* and, at its end remote from the telescoping jib 8, receives a respective one of the holding elements 27*a*, 27*b*. In order to be able to press the cable 16*a*, 16*b* onto the counter holding elements 24*a*, 24*b* by means of the holding elements 27*a*, 27*b*, the pushing element 25*a*, 25*b* can be displaced along the limb 15*a* and 15*b* of the guying support 15. A sliding movement is achieved by a running roller 26*a*, 26*b* disposed on the end of the pushing element 25*a*, 25*b* facing the telescoping jib 8, which running roller rolls in the longitudinal direction L along the outer surface of the telescoping jib 8 and, in the region of the preselected bolting position, on wedge-shaped guide elements 23*a*, 23*b* in the form of raised areas on the outer surface of the telescoping jib 8 and therefore brings about a movement of the pushing element 25*a*, 25*b* in the pushing direction S so that the cable 16*a*, 16*b* is secured or clamped in the region of the bolting position. In order to be able to travel over bolting positions without causing tensioning of the cable 16*a*, 16*b*, only a basic tensioning is provided on the cable 16*a*, 16*b* by means of the tensioning frames 13*a*, 13*b* when further tensioning is then also to be effected via the holding mechanism 17. Without the basic tensioning, the cable 16*a*, 16*b*, when travelling over a non-selected bolting position, is clamped briefly in the non-tensioned condition only by the guide element 23*a*, 23*b* and immediately released.

In the exemplified embodiment, the width b is about 200 cm and the length l of the limbs 15*a*, 15*b* about 95 cm. These dimensions can naturally be different. When establishing the dimensions of the guying supports 15, the correct compromise must be found according to the size of the telescoping jib 8 and of the mobile crane 1 (crane length, crane width, possible jib angle deviation) in order to achieve an increase in bearing load without exceeding the legal vehicle width and height for road operation.

A mechanical embodiment of the holding mechanism 17 is described above. It is fundamentally also possible to envisage driving the holding mechanisms 17 electrically, hydraulically or pneumatically. Instead of the holding elements 27*a*, 27*b* and running rollers 26*a*, 26*b*, sliding elements can also be provided. The guide elements 23*a*, 23*b*, which are preferably designed as wedges, and the pushing elements 25*a*, 25*b* can be replaced by other elements which fix the relative movement of the telescoping sections 10*a-h* with respect to each other during retraction and extension into a fixture of the cable 16*a*, 16*b*, preferably by clamping.

FIGS. 5 to 9 illustrate, in addition to the embodiment depicted in FIG. 4, five further embodiments of a holding mechanism 17. However, the invention is not to be limited to these five exemplified embodiments.

By means of the holding force H applied by the holding mechanism 17, it is fundamentally possible to hold the cable 16*a*, 16*b* on the guying support 15 by a frictional connection and/or by an interlocking connection by means of the holding mechanism 17.

Figure 5:
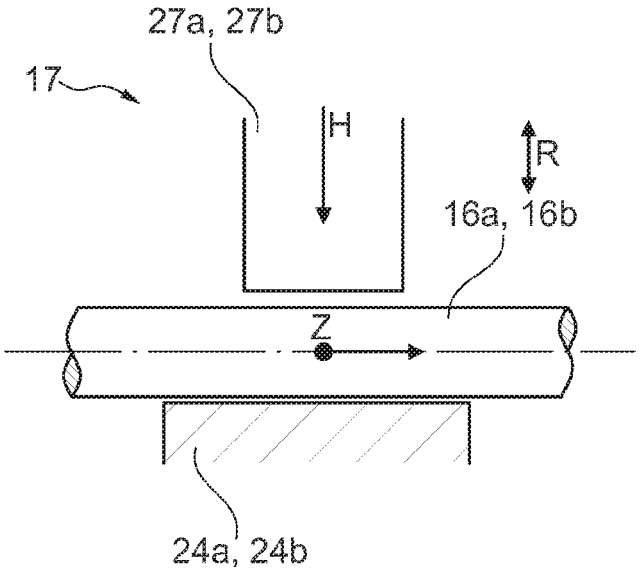
FIG. 5 shows a schematic illustration of a holding mechanism using a frictional connection.
Figure 6:
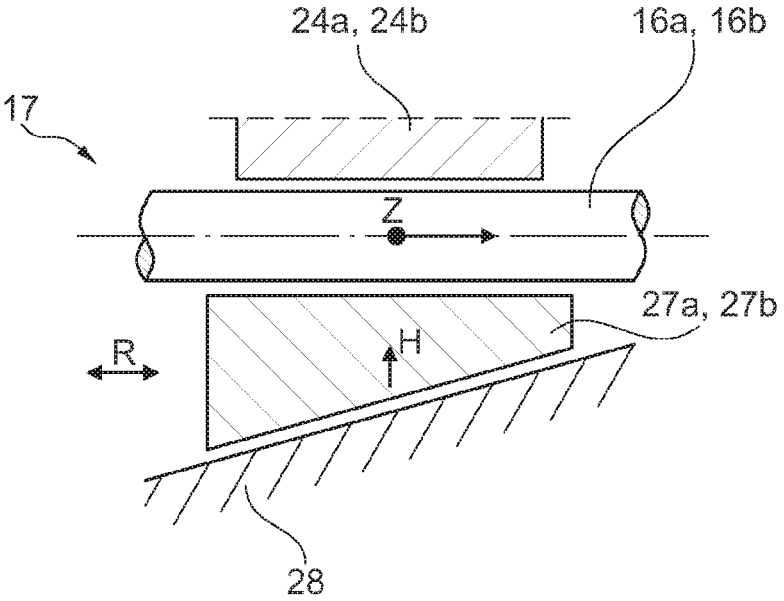
FIG. 6 shows a schematic illustration of a further holding mechanism using a frictional connection.

FIGS. 5 and 6 show exemplified embodiments of a holding mechanism 17 which holds the cable 16*a*, 16*b* by means of a frictional connection. For this purpose, a first holding element 27*a* or a second holding element 27*b* is moved in a linear actuation direction R from an open position into a holding position. In the holding position, the holding element 27*a*, 27*b* acts with a holding force H on the cable 16*a*, 16*b* and presses it against the first counter holding element 24*a* and the second counter holding element 24*b* respectively. In a corresponding manner, the holding force H therefore acts at a right angle with respect to the longitudinal direction of the cable 16*a*, 16*b* and in the direction of the opposing counter holding element 24*a*, 24*b*.

In FIG. 5, the cable 16*a*, 16*b* is clamped-in in a frictionally connected manner between the holding element 27*a*, 27*b*, pushed in the actuation direction R, and the counter holding element 24*a*, 24*b*.

In FIG. 6, the holding element 27*a*, 27*b* is designed as a clamping wedge which can be displaced along a ramp 28 in the actuation direction R. The ramp 28 extends in parallel with the longitudinal direction of the cable 16*a*, 16*b* and rises as seen in the longitudinal direction of the cable 16*a*, 16*b*. By means of a movement of the holding element 27*a*, 27*b* into the holding position, the holding element 27*a*, 27*b* is moved via the ramp 28 towards the cable 16*a*, 16*b* in the direction of the holding force H and therefore presses the cable 16*a*, 16*b* against the counter holding element 24*a*, 24*b*, which is therefore clamped in a frictionally connected manner. In addition, the wedge-shaped holding element 27*a*, 27*b* has an effect which increases the clamping force. If the cable 16*a*, 16*b* is pulled further in the tensioning direction Z, this entrains the wedge-shaped holding element 27*a*, 27*b* by a frictional connection. This thereby moves further up the ramp 28 and increases the holding force H in the direction of the cable 16*a*, 16*b*.

Figure 7:
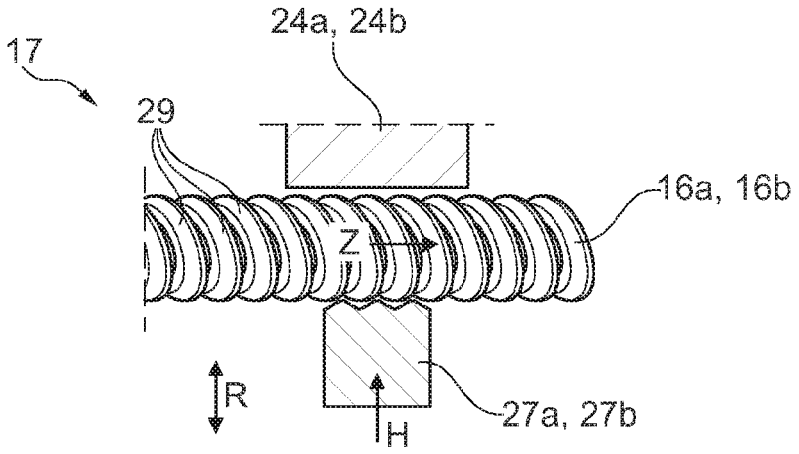
FIG. 7 shows a schematic illustration of a holding mechanism using a frictional and interlocking connection.

The exemplified embodiment illustrated in FIG. 7 presents a combined holding mechanism 17 operating with frictional and interlocking connection. This is fundamentally comparable with the embodiment illustrated in FIG. 5. However, in addition, the holding element 27*a*, 27*b* is provided with profiling on its surface facing the cable 16*a*, 16*b*, which profiling is formed to be substantially complementary to the outer surface of the cable 16*a*, 16*b* and therefore engages in an interlocking manner into the surface of the cable 16*a*, 16*b*. In this case, the turns 29 of the cable 16*a*, 16*b* form a surface of the cable 16*a*, 16*b* with a coil-like and thread-like structure.

Figure 8:
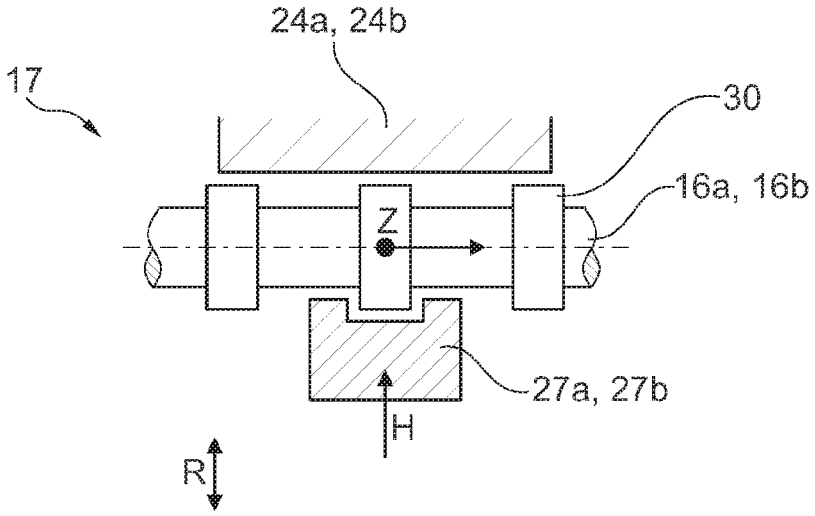
FIG. 8 shows a schematic illustration of a holding mechanism using an interlocking connection.

The holding mechanism 17 according to the exemplified embodiment in FIG. 8 also uses an interlocking connection. The holding element 27*a*, 27*b* is displaced in the actuating direction R as shown in FIGS. 5 and 7. The cable 16*a*, 16*b* is provided, at least in the region of the holding mechanism 17, with formed parts 30 pressed one behind another and spaced apart from each other in the longitudinal direction. In order to be able to produce an interlocking connection instead of a frictional connection between the holding elements 27*a*, 27*b*, the holding element 27*a*, 27*b* is provided, on its surface facing the cable 16*a*, 16*b*, with profiling which is formed in a complementary manner to the outer surface of the cable 16*a*, 16*b* with its formed parts 30. At least one formed part 30 is received in the holding position by the holding element 27*a*, 27*b*. There may also be several if required. In addition to the holding element 27*a*, 27*b* the counter holding element 24*a*, 24*b* can also preferably be provided with profiling (not illustrated) which is suitable for receiving the formed parts 30 and therefore additionally prevents the cable 16*a*, 16*b* from being pulled in the tensioning direction Z.

Figure 9:
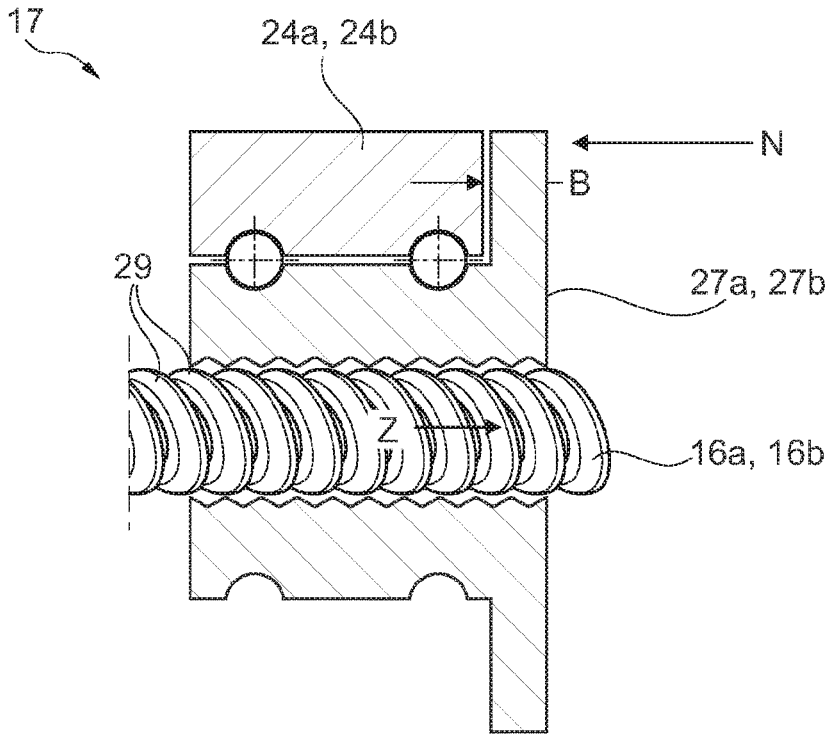
FIG. 9 shows a schematic illustration of a further holding mechanism using an interlocking connection.

The holding mechanism 17 illustrated in FIG. 9 is likewise essentially an interlocking connection which is used to secure the cable 16*a*, 16*b*. FIG. 9 illustrates a holding element 27*a*, 27*b* which is attached, in the manner of a nut, to the cable 16*a*, 16*b* with its profiled, thread-like outer surface. These holding elements 27*a*, 27*b* can correspondingly rotate about the thread produced by the cable turns 30 when the cable 16*a*, 16*b* is moved in or opposite to the tensioning direction Z, e.g. during extension and retraction of the telescoping jib 8. In order to move the holding mechanism 17 from its open position into its holding position, in this embodiment, the rotational movement of the holding element 27*a*, 27*b* is to be blocked. For this purpose, a blocking device, e.g. a brake, is to be provided between the counter holding element 24*a*, 24*b*, in which the holding element 27*a*, 27*b* is rotationally mounted, and the holding element 27*a*, 27*b*. In FIG. 9, this is indicated by the arrow B. When the holding element 27*a*, 27*b* is prevented from rotating, the holding element 27*a*, 27*b* holds the cable 16*a*, 16*b* opposite to the tensioning direction Z in a manner comparable to the embodiment according to FIG. 7.

Furthermore, it is self-evident that the guying system 11 also functions with chains instead of with cables 16*a*, 16*b* so that, in terms of the invention, the cables 16*a*, 16*b* are to be understood as flexible tensioning means.

The invention claimed is:

1. A telescoping jib of a mobile crane comprising:

a lifting cable and a drum operable to wind and unwind the lifting cable;

a jib basic box with a four-sided cross-section;

a plurality of telescoping sections each with a four-sided cross-section that telescope inwards and outwards from the jib basic box; and a guying system for the telescoping jib, wherein the guying system comprises at least one tensioning cable that extends between at least one tensioning winch and at least one fixed point via at least two guying supports, wherein each guying support is disposed in each case on an outer head end of a jib basic box head or on an outer head end of a telescoping section head and comprises a holder for the tensioning cable, wherein the holder secures the tensioning cable by a frictional and/or interlocking connection in a holding position after tensioning by the at least one tensioning winch and releases the tensioning cable in an open position, wherein each guying support comprises a through-hole for the tensioning cable which is to be passed through and wherein the holder comprises a movable holding element with which the tensioning cable can be secured in an operating condition in the through-hole against a counter holding element.

2. The telescoping jib as claimed in claim 1, wherein a further guying support supports the fixed point on the telescoping section head of an innermost telescoping section.

3. The telescoping jib as claimed in claim 2, wherein a guying support is disposed on the jib basic box and each telescoping section respectively.

4. The telescoping jib as claimed in claim 1, wherein the at least one tensioning frame of the guying system is disposed on the jib basic box.

5. The telescoping jib as claimed in claim 4, wherein the tensioning cable is secured on the tensioning winch and on a last telescoping section head of a last telescoping section.

6. The telescoping jib as claimed in claim 5, wherein a first tensioning winch and a second tensioning winch are disposed on the jib basic box and cooperate with a first tensioning cable and a second tensioning cable which extend in parallel with each other and in the longitudinal direction of the telescoping jib.

7. The telescoping jib as claimed in claim 6, wherein each guying support comprises two limbs which, as seen in the longitudinal direction of the telescoping jib, from a middle of the telescoping jib, are disposed on the right and left on the telescoping jib and form an angle of 45 degrees to 135 degrees.

8. The telescoping jib as claimed in claim 7, wherein the successive telescoping sections and the jib basic box can be secured to one another.

9. The telescoping jib as claimed in claim 1, wherein a guying support is disposed on the jib basic box and each telescoping section respectively.

10. The telescoping jib as claimed in claim 1, wherein the at least one tensioning winch of the guying system is disposed on the jib basic box.

11. The telescoping jib as claimed in claim 1, wherein the tensioning cable is secured on the tensioning winch and on a last telescoping section head of a last telescoping section.

12. The telescoping jib as claimed in claim 1, wherein a first tensioning winch and a second tensioning winch are disposed on the jib basic box and cooperate with a first tensioning cable and a second tensioning cable which extend in parallel with each other and in the longitudinal direction of the telescoping jib.

13. The telescoping jib as claimed in claim 12, wherein each guying support comprises two limbs which, as seen in the longitudinal direction of the telescoping jib, from a middle of the telescoping jib, are disposed on the right and left on the telescoping jib and form an angle of 45 degrees to 135 degrees.

14. A method for guying a telescoping jib of a mobile crane, wherein the telescoping jib comprises a lifting cable and a drum operable to wind and unwind the lifting cable, a jib basic box with a four-sided cross-section and a plurality of telescoping sections each with a four-sided cross-section, and wherein at least one tensioning cable is guyed between a tensioning winch on the telescoping jib and a fixed point on the telescoping jib, and wherein the at least one tensioning cable is guided by at least two guying supports supported on an outer head end of the jib basic box head or on an outer head end of a telescoping section head of the telescoping jib, wherein the method comprises extending the telescoping sections out of the jib basic box, tensioning the at least one tensioning cable between the tensioning frame winch and the fixed point, and securing the at least one tensioning cable on each guying support via a holder being moved from an open position to a holding position, wherein tensioning the at least one tensioning cable between the tensioning winch and the fixed point comprises starting from a transportation condition of a retracted telescoping jib, beginning with the last telescoping section in the longitudinal direction of the telescoping jib and continuing with the adjoining telescoping section in each case, after each extension of a telescoping section the at least one tensioning cable of the guying system is tensioned by the at least one tensioning winch and secured by the holder.

* * * * *